US006628082B2

(12) United States Patent
Matsumoto et al.

(10) Patent No.: US 6,628,082 B2
(45) Date of Patent: Sep. 30, 2003

(54) GLOW STARTER FOR A HIGH PRESSURE DISCHARGE LAMP

(75) Inventors: Naoya Matsumoto, Kanagawa-ken (JP); Hiroyuki Ogata, Kanagawa-ken (JP); Satoshi Iwasawa, Kanagawa-ken (JP); Takahito Kashiwagi, Kanagawa-ken (JP); Akira Ito, Kanagawa-ken (JP); Daisuke Takayama, Kanagawa-ken (JP); Makoto Hashimoato, Kanagawa-ken (JP); Toshihiko Ishigami, Kanagawa-ken (JP)

(73) Assignee: Toshiba Lighting & Technology Corporation, Tokyo (JP)

( * ) Notice: Subject to any disclaimer, the term of this patent is extended or adjusted under 35 U.S.C. 154(b) by 155 days.

(21) Appl. No.: 09/886,053

(22) Filed: Jun. 22, 2001

(65) Prior Publication Data

US 2002/0000780 A1 Jan. 3, 2002

(30) Foreign Application Priority Data

| | | |
|---|---|---|
| Dec. 26, 2000 | (JP) | 2000-395470 |
| Nov. 7, 2000 | (JP) | 2000-338780 |
| Jun. 30, 2000 | (JP) | 2000-199993 |

(51) Int. Cl.[7] ..... H01J 7/44

(52) U.S. Cl. ..... 315/58; 315/61; 315/71; 315/291; 313/619; 313/571; 313/642

(58) Field of Search ..... 315/58, 59, 61, 315/71, 72, 290, 291; 313/113, 491, 571, 637, 642, 619

(56) References Cited

U.S. PATENT DOCUMENTS

| | | | | |
|---|---|---|---|---|
| 4,350,929 A | * | 9/1982 | Katoogi | 315/49 |
| 5,057,741 A | * | 10/1991 | Barakitis et al. | 313/619 |
| 5,109,183 A | * | 4/1992 | Robertson et al. | 315/58 |
| 5,331,250 A | * | 7/1994 | Ravi et al. | 315/71 |
| 6,215,254 B1 | * | 4/2001 | Honda et al. | 315/246 |
| 6,300,716 B1 | * | 10/2001 | Honda | 315/51 |

FOREIGN PATENT DOCUMENTS

| | | |
|---|---|---|
| JP | SHO 63-3086 | 1/1988 |
| JP | HEI 1-134848 | 5/2001 |

* cited by examiner

*Primary Examiner*—Haissa Philogene
(74) *Attorney, Agent, or Firm*—Pillsbury Winthrop LLP

(57) ABSTRACT

A glow starter comprises a discharge vessel, filled with a filling including a rare gas, substantially transmitting ultraviolet rays of about 300 nm or less. A pair of electrodes, which are arranged in the discharge vessel, is adapted and arranged to touch each other by being heated by a glow discharge. The glow starter may be used for a high pressure discharge lamp, a high pressure discharge lamp apparatus, or a lighting fixture.

7 Claims, 6 Drawing Sheets

GLOW STARTER FOR A HIGH PRESSURE DISCHARGE LAMP

BACKGROUND OF THE INVENTION

1. Field of the Invention

The present invention relates to a glow starter, which can be applied to a high pressure discharge lamp.

2. Description of the Related Art

High pressure discharge lamps, such as metal halide discharge lamps are increasingly utilized in lighting fixtures because of their high efficiency and color rendering property in comparison with mercury vapor lamps. The metal halide discharge lamp, however, does not start easily, because it is typically supplied with a low discharge starting voltage or a secondary voltage generated by a ballast, such as that which is usually applied to a mercury vapor lamp. The ballast for the mercury vapor lamp is generally utilized, because it is low in cost and compact. However, the starting voltage of the metal halide lamp tends to be high as a result of impurities, e.g., moisture ($H_2O$), which can easily be included with the metal halide and rare gas when the arc tube is filled. The impurities make it more difficult for a discharge to start. In order to improve the starting, the filling pressure of the rare gas can be decreased. However, when the pressure of the rare gas is reduced, the electron emissive material of the electrodes is vaporized excessively at the beginning of the discharge. As a result, the arc tube is blackened, and its luminous flux is reduced over the lamp's operation.

To solve this problem, when a ballast for a mercury vapor lamp is used in a metal halide lamp, the lamp includes a starter device including a glow starter connected in parallel to the arc tube. When current from the ballast initially passes through the grow starter, an arc discharge is created. As the arc discharge heats bi-metallic elements in the glow starter, the bimetallic elements touch to directly pass current. This causes the arc discharge to be extinguished and the bimetallic elements cool. When the elements cool sufficiently, they separate, creating a counter-electromagnetic force in the ballast which produces a high starting voltage pulse for the metal halide lamp.

To improve starting, a metal halide lamp may comprise an initial electron generating material, e.g., promethium ($^{147}Pm$). However, it is difficult to handle and dispose of promethium ($^{147}Pm$) because it is a radioactive isotope.

Furthermore, Japanese Laid Open Patent Application HEI 1-134848 discloses a metal halide lamp which starts more easily. Such metal halide lamp comprises an ultraviolet ray generator arranged near the arc tube. The generator irradiates the arc tube with ultraviolet rays, so that the metal halide lamp tends to start more easily. The ultraviolet ray generator includes an ultraviolet ray-transmitting vessel made of a borosilicate glass or a silica glass, and a single electrode. Furthermore, the vessel of the generator is arranged near a lead wire which supplies electric current to an electrode of the arc tube. According to the application, ultraviolet rays are generated between the lead wire and the single electrode before the metal halide lamp starts. The metal halide lamp does not have a glow starter in the outer bulb, but has an igniter outside. This metal halide lamp has both the ultraviolet ray generator and the igniter to assist in starting the metal halide lamp.

Furthermore, Japanese Laid Open Utility Model Application SHO 63-3086 discloses generating ultraviolet rays using a glow starter. The glow starter includes a vessel made of a quartz glass or a silica glass filled with mercury (Hg), so that ultraviolet rays are generated by a mercury vapor discharge. The application further discloses that the glow starter vessel is made of soft glass and ultraviolet rays of 297 nm, 302 nm, and 313 nm are generated by the mercury vapor discharge. However, in order to generate ultraviolet rays of 297 nm, 302 nm, and 313 nm, a large amount of mercury may be required, which is not friendly to the environment.

SUMMARY OF THE INVENTION

According to one aspect of the invention, a glow starter comprises a discharge vessel, filled with a gas mix including a rare gas. The glow starter transmits ultraviolet rays substantially of about 300 nm or less. A pair of electrodes, which are arranged in the discharge vessel, are adapted and arranged to touch each other as a result of being heated by a glow discharge.

According to another aspect of the invention, a high pressure discharge lamp comprises an arc tube, the glow starter, and an outer bulb accommodating the arc tube and the glow starter.

According to another aspect of the invention, a high pressure discharge lamp apparatus comprises a high pressure discharge lamp. A ballast, which has a rated input voltage of about 100V or about 200V, and supplies a secondary voltage between about 200V and about 220V to the high pressure discharge lamp, is arranged in series between an alternating current supply and the high pressure discharge lamp.

According to another aspect of the invention, a lighting fixture comprises a high pressure discharge lamp apparatus, and a body having a lamp socket and a reflector.

These and other aspects of the invention will be further described in the following drawings and detailed description of the invention.

BRIEF DESCRIPTION OF THE DRAWINGS

The invention will be described in more detail below by way of examples illustrated by drawings in which.

DETAILED DESCRIPTION OF SEVERAL EMBODIMENTS OF THE INVENTION

A first embodiment of the present invention will be described in detail with reference to FIG. 1.

Figure 1:
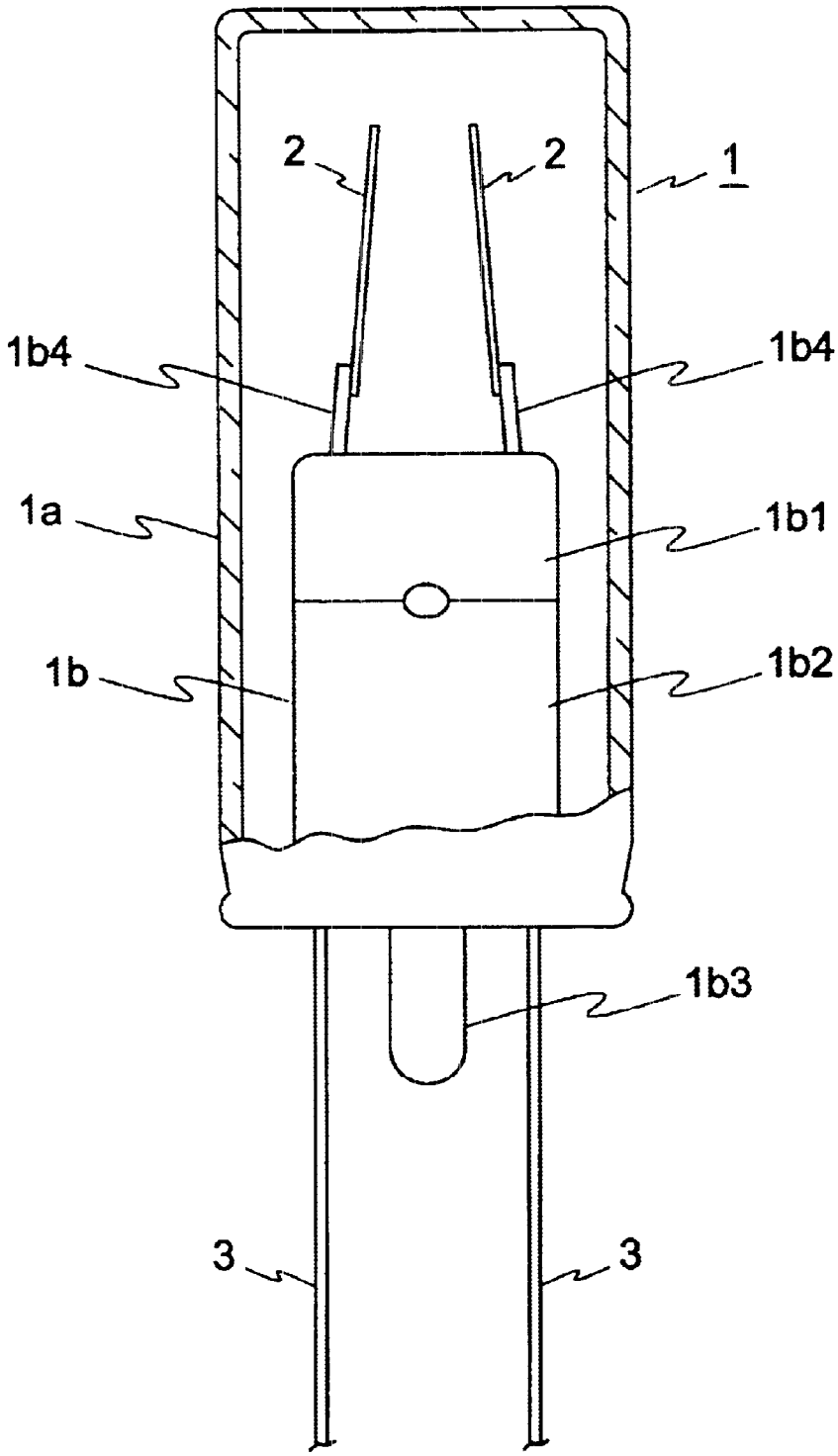
FIG. 1 is an enlarged side view, partly in section, of a glow starter according to a first embodiment of the present invention.

FIG. 1 shows an enlarged side view, partly in section, of a glow starter according to a first embodiment. The glow starter is provided with a discharge vessel 1, a pair of electrodes 2 in the discharge vessel 1, and a pair of outer conductive wires 3.

The discharge vessel 1 comprises a tube 1*a*, and stem 1*b*. The tube 1*a* made of a soft glass, is filled with a rare gas and mercury (Hg), and can substantially transmit ultraviolet rays of about 300 nm or less generated by a rare gas discharge and a mercury vapor discharge. The soft glass, which mainly comprises silicon oxide ($SiO_2$), but includes no more than about 0.01 weight % of iron oxide ($Fe_2O_3$), has a coefficient of thermal expansion of about $40*10^{-7}/°$ C. or more at a temperature between about 100 and about 300° C. The discharge vessel may transmit about 20% or more of ultraviolet rays of about 254 nm generated by a mercury vapor discharge.

The stem 1*b*, made of soft glass, is provided with a pinch sealed portion 1*b*1, a flare portion 1*b*2, and an exhaust tube 1*b*3. The exhaust tube 1*b*3, held at the pinch sealed portion 1*b*1, can exhaust tube 1*a* and introduce a filling including rare gas of argon (Ar) of a pressure of about $1.2*10^3$Pa, and mercury (Hg) of very small amount. Each of inner conductive wires 1*a*4 is respectively connected to the outer conductive wires 3 via a dumet wire (not shown) embedded in the pinch sealed portion 1*b*1.

The transmittance of the glass may be about 20% or more. It is more preferable that the transmittance is about 40% or more. The discharge vessel 1 may be made of soft glass, quartz glass, or light-transmitting ceramics. When the discharge vessel is made of soft glass, existing machines and processes for manufacturing conventional grow starters can be easily utilized. Therefore, the glow starter can be cheaply manufactured. Furthermore, soft glass, e.g., soda-lime glass, comprises mainly sodium oxide, calcium oxide, and silicon oxide ($Na_2O$—$CaO$—$5SiO_2$). The soda-lime glass may further comprise aluminum oxide ($Al_2O_3$), magnesium oxide (MgO), or potassium ($K_2O$), and so on. However, any impurities, e.g., iron oxide ($Fe_2O_3$), should be minimized. When iron oxide ($Fe_2O_3$) is comprised present beyond a minimal amount, it is difficult for ultraviolet rays to transmit outwardly. The amount of iron oxide ($Fe_2O_3$) may be about 0.01 weight % or less. When amount of iron oxide ($Fe_2O_3$) is about 20 ppm or less, ultraviolet rays can be transmitted more easily. Furthermore, lead oxide (PbO) should be minimized to improve the transmittance of ultraviolet rays.

One end of each of electrodes 2, made of bimetal, is connected to one end of a respective inner conductive wire 1*b*4. The other ends of the electrodes 2 have a predetermined space therebetween. When the electrodes 2 generate a glow discharge, the electrodes 2 themselves are heated by the glow discharge, so that the ends of the electrodes 2 can come into contact. The electrodes 2 may further have an emitter made of, e.g., barium oxide (BaO), or an activator made of, e.g., barium (Ba), or lanthanum (La), in order to generate a glow arc more easily.

The filling including rare gas can generate ultraviolet rays having a wavelength of about 300 nm or less. The filling may further comprise mercury (Hg). The rare gas may further comprise an organic compound gas including hydrogen ($H_2$), or propane ($C_3H_8$) in order to increase the discharge current. The rare gas may comprise argon (Ar) and neon (Ne) in order to reduce the starting voltage of the glow starter. For example, the starting pulse voltage is about 1.2 KV in this embodiment.

Figure 2:
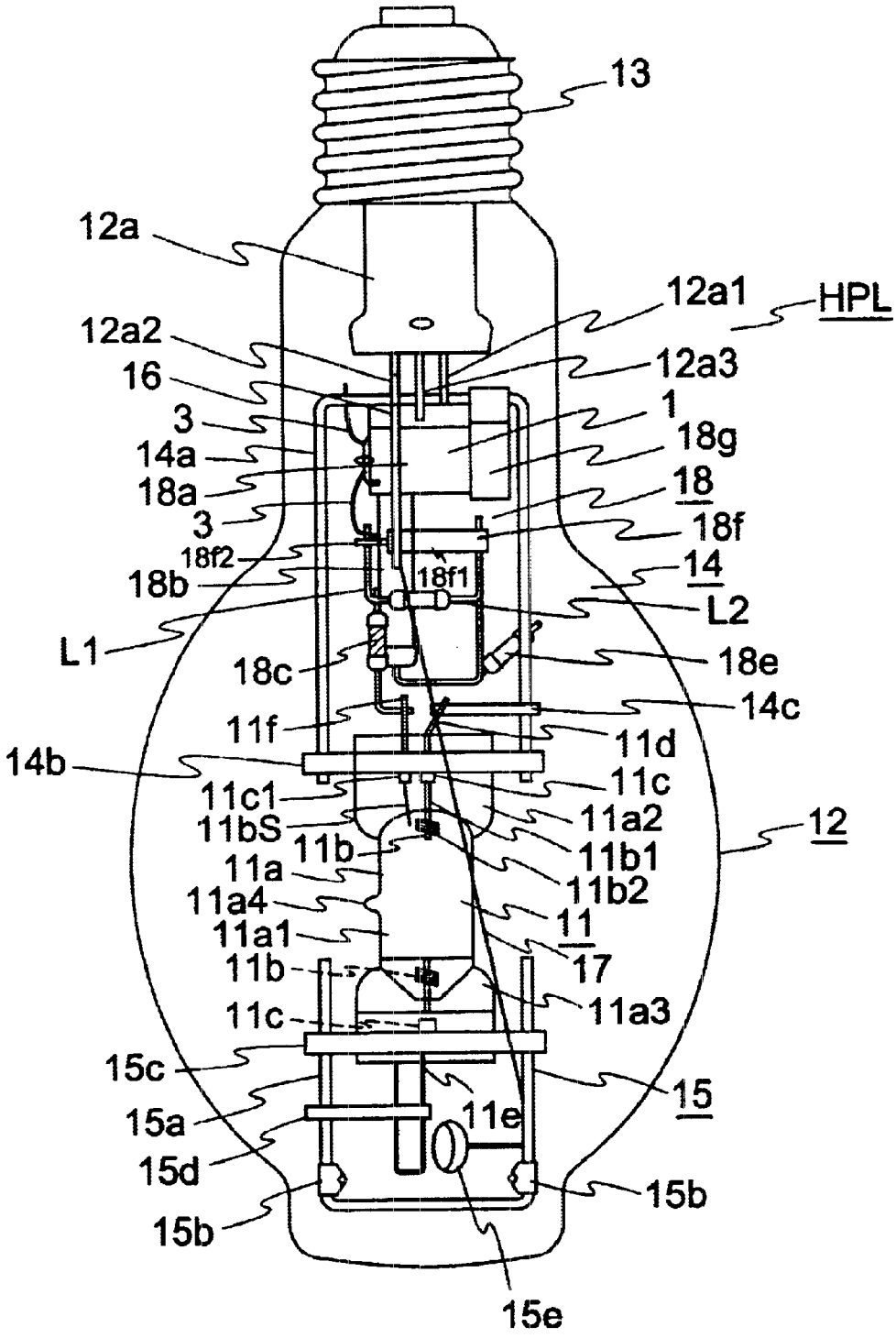
FIG. 2 is a side view of a high pressure discharge lamp according to the present invention.

FIG. 2 is a side view of a high pressure discharge lamp. Similar reference characters designate identical or corresponding elements of the above embodiment. Therefore, detailed explanation of the structure will not be provided.

The high pressure discharge lamp HPL, e.g., a metal halide lamp having a rated power of about 400 W, comprises an arc tube 11, an outer bulb 12, a lamp cap 13, an upper supporting element 14, a lower supporting element 15, connecting conductors 16, 17 and a starting device 18.

The arc tube 11 comprises a light-transmitting discharge vessel 11*a* made of quartz glass, and a discharge space 11*a*1 filled with an ionizable gas including mercury (Hg), a rare gas, e.g., argon (Ar) of about $6.7*10^3$Pa at filling pressure, and a metal halide, e.g., a total amount of both scandium iodide (ScI) and sodium iodide (NaI) of about 30 mg, and sodium iodide (NaBr) of about 2.7 mg.

The metal halide may comprise either bromide (Br) or iodide (I), and either rare earth elements or alkaline metals. The rare gas may be neon (Ne), argon (Ar), or xenon (Xe). The discharge vessel 11*a*, having an inner diameter of about 20 mm, air-tightly closed at a pair of sealing portions 11*a*2, 11*a*3, can transmit visible light and ultraviolet rays having a wavelength of about 300 nm or less. The discharge vessel 11*a* further has an exhausting portion 11*a*4. The inner surface of the sealing portion 11*a*2 is formed into a hemisphere shape. However, the inner surface of the sealing portion 11*a*3 is formed into a cone shape. The sealing portion 11*a*3 may have a heat-insulating layer on the outer surface thereof. Of course, other shapes and sizes can be used. The discharge vessel 11*a* may be made of a ceramics having light-transmitting characteristics, e.g., either monocrystalline or poly-crystalline alumina, yttrium alumnum garnet (YAG), or yttrium oxide (YOX). The bulb wall loading of the arc tube 11 is about 17.7 W/cm$^2$, for example.

Each of electrodes 11*b*, made of tungsten, comprises an electrode rod 11*b*1, and a coil 11*b*2 arranged near the tip of the rod 11*b*1. One end of each of the electrodes 11*b* is respectively embedded in the sealing portions 11*a*2, 11*a*3 and connected to one of outer conductive wires 11*d*, 11*e* via molybdenum foils 11*c* embedded in the sealing portions 11*a*2, 11*a*3. The outer conductive wire 11*d* extends outwardly from the discharge vessel 11. The outer conductive wire 11*e*, formed into a U-shape, extends outwardly from the sealing portion 11*a*3. The ends of electrodes 11*b* are separated by about 36 mm.

The outer bulb 12, made of hard glass, includes a main portion having a maximum outer diameter, a neck portion sealed by a flare stem 12*a*, and a summit portion. Of course, other shapes and sizes can be used. The flare stem 12*a* holds a pair of conductive wires 12*a*1, 12*a*2, and an anchor 12*a*3. The outer bulb 12 may be filled with an inert gas, e.g., nitrogen. Also the bulb 12 is covered with fluorine-containing polymer, so as not to be scattered if it is broken.

An aid electrode 11*b*S, made of tungsten, is further connected to a conductive wire 11*f* having a molybdenum foil 11*c*1 embedded in the sealing portion 11*a*2. A tip of the aid electrode 11*b*S is arranged adjacent to the electrode 11*b*.

The lamp cap 13 held by the neck portion includes a shell portion and a center contact, which are respectively connected to the conductive wires 12*a*1, 12*a*2.

The upper supporting element 14 comprises a U-shaped current conductor 14*a*, a metal band 14*b*, and a thin conductor 14*c*. The U-shaped current conductor 14*a* is held by the conductive wire 12*a*1 and the anchor 12*a*3 by means of welding. The metal band 14*b*, which is welded with the U-shaped current conductor 14*a*, fastens the sealing portion 11*a*2 of the discharge vessel 11*a*. The thin conductor 14*c* is connected to the outer conductive wire 11*d* at one end thereof, and welded with the U-shaped current conductor 14*a* at the other end thereof. Accordingly, the upper electrode 11*b* is connected in series to the molybdenum foil 11*c*, the outer conductive wire 11*d*, the thin conductor 14*c*, the U-shaped current conductor 14*a*, the conductive wire 12*a*1, and the shell portion of the lamp cap 13.

The lower supporting element 15 comprises a U-shaped current conductor 15*a*, a spring member 15*b*, a metal band 15*c*, a thin conductor 15*d*, and a getter 15*e*. The U-shaped current conductor 15*a* mechanically supports the arc tube 11. The spring member 15*b*, which is welded with the U-shaped current conductor 15*a*, is arranged so as to touch itself to the inner surface of the summit portion of the outer bulb 12. The metal band 15*c*, which is welded with the U-shaped current conductor 15*a*, fastens the sealing portion 11*b*3 of the discharge vessel 11*a*. The thin conductor 15*d* is connected between the U-shaped current conductor 15*a* and the U-shaped outer conductive wire 11*e*. The getter 15*e*, welded the U-shaped current conductor 15*a*, can absorb an impurity gas in the outer bulb 12.

The connecting conductor 16, which is welded with the conductive wire 12*a*2 at one end, is supported apart from the upper supporting element 14. The connecting conductor 17 made of a fine wire is welded with the connecting conductor 16 at one end. The other end of the connecting conductor 17 is welded with the U-shaped current conductor 15*a*, so that the connecting conductor 17 is arranged along the arc tube 11. Accordingly, the lower electrode 11*b* is connected in series to the molybdenum foil 11*c*, the outer conductive wire 11*e*, the thin conductor 15*d*, the U-shaped current conductor 15*a*, the connecting conductors 17, 16, the conductive wire 12*a*2, and the center contact of the lamp cap 13.

Figure 3:
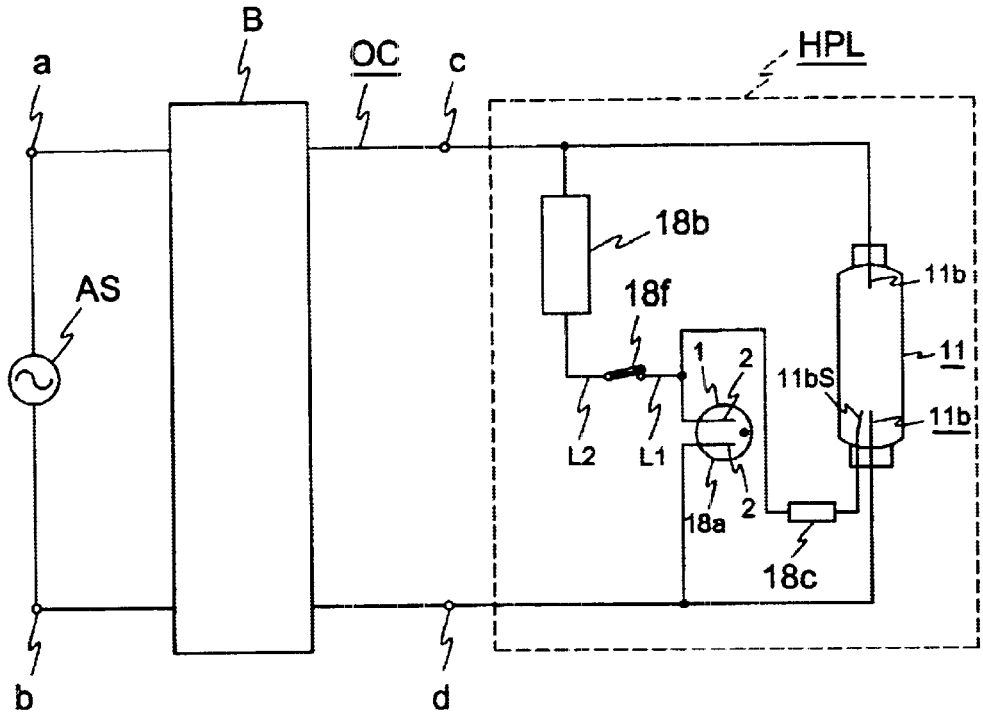
FIG. 3 is a circuit diagram of a high pressure discharge lamp apparatus according to the first embodiment of the present invention.

The starting device 18, to which occurs a starting pulse voltage is applied from a ballast B shown in FIG. 3 and which produces a photoelectric effect in the arc tube 11, comprises a glow starter 18*a* shown in FIG. 1, resistors 18*b*, 18*c*, insulators 18*d*, 18*e*, a bimetal element 18*f*, and a metal holder 18*g* supporting the glow starter 18*a*. The metal holder 18*g* supports the glow starter 18*a* so as not to cut off ultraviolet rays generated by the glow starter 18*a*. The outer conductive wire 3 of the glow starter 18*a* is connected to the U-shaped current conductor 14*a*. The other conductive wire 3 is connected to the lead wire L1 of the insulator 18*d*. One lead wire of the resistor 18*b* is connected to the connecting conductor 16. The other lead wire of the resistor 18*b* is connected to the lead wire L2 of the insulator 18*d*. Moreover, one lead wire of the resistor 18*c* is connected to the lead wire L1 of the insulator 18*d*. The other lead wire of the resistor 18*c* is connected to the aid electrode 11*b*S via a molybdenum foil 11*f*. The insulator 18*e* is arranged between the resistor 18*b* and the U-shaped current conductor 14*a*. The bimetal element 18*f*, which comprises a bimetal plate 18*f*1 and a contacting member 18*f*2, is usually closed. The one end of the bimetal plate 18*f*1 is connected to the lead wire L2 of the insulator 18*d* by welding. The one end of the contacting member 18*f*2 is welded with the other end of the bimetal plate 18*f*1. Therefore, the other end of the contacting member 18*f*2 can separate from the lead wire L1, when the bimetal plate 18*f*1 deforms. Furthermore, the glow starter 18*a* is arranged to irradiate the arc tube 11 with ultraviolet rays generated therefrom. In this embodiment, the glow starter 18*a* is separated from the arc tube 11 by about 10 cm. Furthermore, the glow starter 18*a* may be held by a case, which transmits the ultraviolet rays generated by the glow starter 18*a*.

FIG. 3 shows a circuit diagram of the high pressure discharge lamp apparatus. The series circuit, which includes the resistor 18*b*, the lead wire L2 of the insulator 18*d*, the bimetal element 18*f*, the lead wire L1 of the insulator 18*d*, and the glow starter 18*a*, is connected in parallel to the arc tube 11. Moreover, another series circuit, including the resistor 18*b*, the lead wire L2, the bimetal element 18*f*, the lead wire L1, and the resistor 18*c*, is connected between the upper electrode 11*b* and the aid electrode 11*b*S. An operating circuit OC comprises an alternating current power supply AS having a rated voltage of about 200V, a ballast B having terminals a, b, c, and d, and the high pressure discharge lamp HPL. The ballast B for a mercury vapor lamp outputs about 400 W. The ballast B, having a rated voltage of about 200V, mainly comprises an inductor, and can stably light up the metal halide lamp. The ballast may have a rated input voltage of about 100V, and supplies a secondary voltage between about 200V and about 220V to the high pressure discharge lamp. Of course, the ballast may be specifically designed for a metal halide lamp.

When the ballast for a mercury vapor lamp is used for a metal halide lamp, it has been a concern that the lamp may occasionally extinguish during lamp operation. However, when the high pressure discharge lamp has a filling containing mainly scandium iodide (ScI) and sodium iodide (NaI), the metal halide lamp can remain lit.

When the alternating current power AS is supplied to the ballast B, the ballast generates a secondary voltage applied to the high pressure discharge lamp HPL. However, the high pressure discharge lamp HPL can not start yet. The glow starter 18*a* generates a glow discharge between the electrodes 2, when the secondary voltage is supplied to the high pressure discharge lamp HPL. The glow discharge generates ultraviolet rays of about 300 nm or less which irradiate the arc tube 11 through the discharge vessel 1. As a result, the photoelectric effect occurs in the arc tube 11, and secondary electrons from the electrodes 1*b* are easily generated. Furthermore, the electrodes 2 of the glow starter 18*a* are heated by the glow discharge thereof, so that the electrodes 2 deform and touch each other. After the electrodes 2 touch, the glow starter 18*a* operates as a resistor in order to draw an appropriate current from the ballast B. For a while, the electrodes 2 cool because they are not generating a glow discharge. Therefore, the electrodes 2 separate from one another. At that time, a starting pulse voltage, which is generated by a counter-electromotive force within the ballast B, is supplied between the lower electrode 1*b* and the aid electrode 1*b*S, so that an aid discharge occurs. The aid discharge aids a main discharge between the electrodes 1*b*, 1*b*. As a result, the high pressure discharge lamp HPL starts to light up.

After a while, the main discharge also heats the bimetal element 18*f*, so that the contacting member 18*f*2 parts from the lead wire L1 of the insulator 18*d*. Therefore, the glow starter 18*a* cannot operate again because it is disconnected from the high pressure discharge lamp HPL. The aid electrode 11*b*S also is disconnected electrically and does not discharge during lamp operation.

Figure 4:
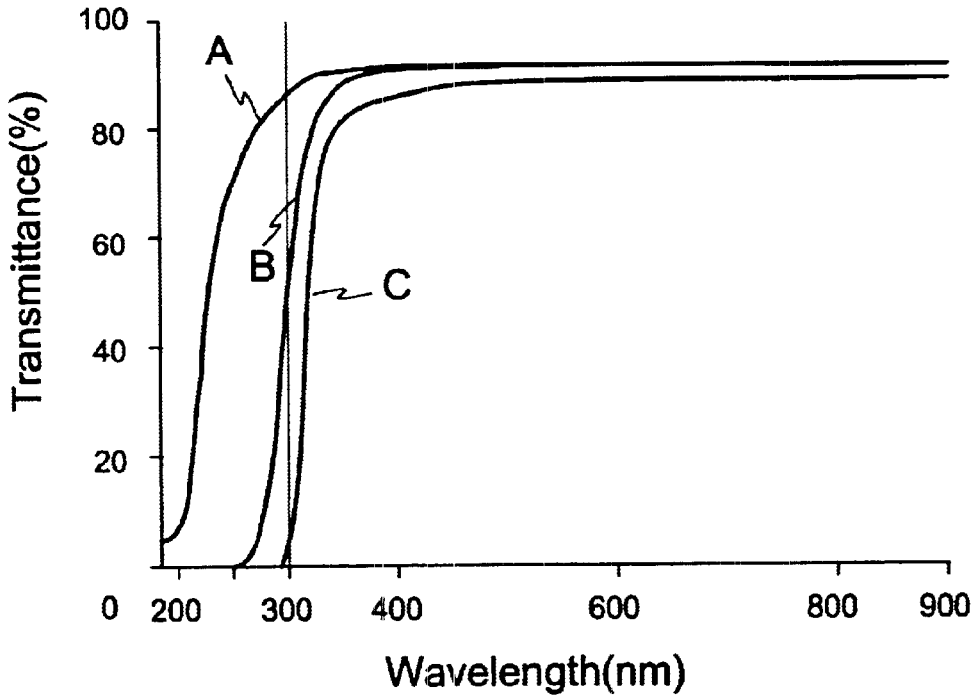
FIG. 4 is a graph showing a transmittance as a wavelength according to the present invention.

FIG. 4 shows a graph of transmittance as a function of wavelength according to the first embodiment. The vertical axis of the graph shown in FIG. 4 indicates transmittance (%), and the horizontal axis indicates wavelength (nm). The lines A, B, and C respectively indicate the transmittance of a first glass, a second glass, and a comparative glass. Each glass has a thickness of about 0.8 mm.

The first glass, which is made of soda-lime glass including iron oxide ($Fe_2O_3$) of about 0.01 weight % or less, transmits about 68% of the ultraviolet rays at a wavelength of about 254 nm, and about 88% of the ultraviolet rays at a wavelength of about 300 nm. The detailed composition of the first glass is as follows: silicon oxide ($SiO_2$) of about 68.90 weight %, aluminum oxide ($Al_2O_3$) of about 1.32 weight %, iron oxide ($Fe_2O_3$) of about 17 ppm (0.0017 weight %), sodium oxide ($Na_2O$) of about 8.53 weight %, potassium oxide ($K_2O$) of about 8.56 weight %, calcium oxide (CaO) of about 78 ppm (0.0078 weight %), barium oxide (BaO) of about 9.97 weight %, boron oxide ($B_2O_3$) about 2.33 weight %, titanium oxide ($TiO_2$) of about 5 ppm (0.0005 weight %), and chlorine (Cl) of about 0.27 weight %. Furthermore, the first glass has a coefficient of thermal expansion of about $96.9*10^{-7}$/° C., a glass transition temperature of about 500° C., a contraction temperature of about 570° C., a softening temperature of about 679° C., an annealing point of about 487° C., and a strain temperature of about 443° C.

The second glass, which is made of soft glass which is lead glass with the lead (Pb) substantially removed, transmits about 48% at a wavelength of about 300 nm.

The comparative glass, which is made of lead glass used for a flare stem, transmits about 4% at a wavelength of about 300 nm. The detailed composition of the comparative glass is follows: silicon oxide ($SiO_2$) of about 70.30 weight %, aluminum oxide ($Al_2O_3$) of about 1.91 weight %, iron oxide ($Fe_2O_3$) of about 0.036 weight %, sodium oxide ($Na_2O$) of about 16.00 weight %, potassium oxide ($K_2O$) of about 1.24 weight %, calcium oxide (CaO) of about 5.12 weight %, magnesium oxide (MgO) of about 3.34 weight %, strontium oxide (SrO) of about 0.02 weight %, barium oxide (BaO) of about 0.09 weight %, boron oxide ($B_2O_3$) of about 0.83 weight %, titanium oxide ($TiO_2$) of about 0.01 weight %, zinc oxide (ZnO) of about 0.08 weight %, zirconium oxide ($ZrO_2$) of about 0.03 weight %, phosphorus oxide ($P_2O_5$) of about 0.32 weight %, antimony oxide ($Sb_2O_3$) of about 0.23 weight %, sulfur oxide ($SO_3$) of about 0.16 weight %, and chlorine (Cl) of about 0.02 weight %. Furthermore, the comparative glass has a coefficient of thermal expansion of about $95.6*10^{-7}$/° C., a glass transition temperature of about 540° C., a contraction temperature of about 600° C., a softening temperature of about 693° C., an annealing point of about 517° C., and a strain temperature of about 473° C.

Twenty of each of three metal halide lamps, which utilize glow starters and have the first, the second, or the comparative glass, were manufactured. The metal halide lamps, using the glow starter and made of the first or the second glass, could start to light up rapidly in at least in ten seconds. However, the metal halide lamps, using the glow starter and made of the comparative glass, could not start in two minutes. When the glass of the glow starter transmits about 20% or more at the wavelength of about 300 nm or less, the metal halide lamp can start easily. Moreover, when the glass of the glow starter transmits about 40% or more, the arc tube can sufficiently receive ultraviolet rays. Accordingly, the glow starter can be arranged apart from the arc tube, so as not to obstruct the visible light generated from the arc tube.

Figure 5:
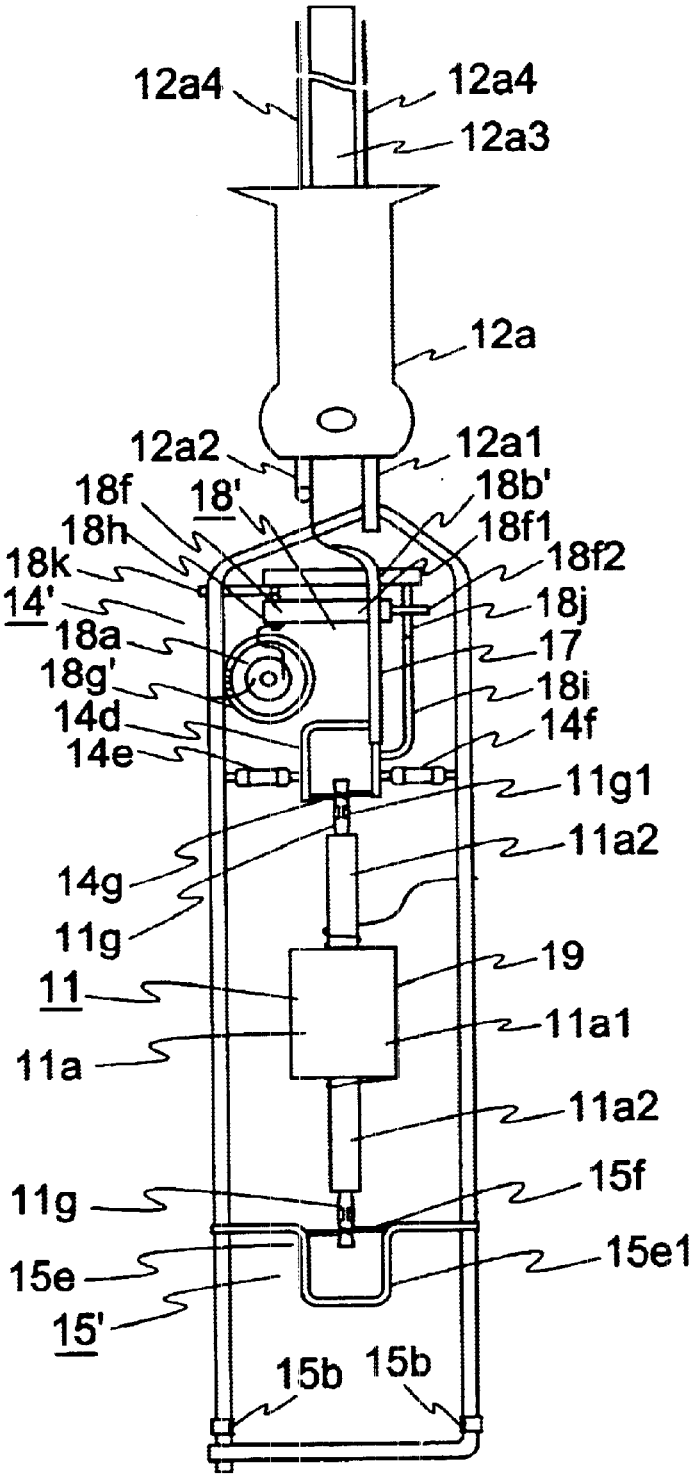
FIG. 5 is a side view of an assembly of a metal halide lamp according to a second embodiment of the present invention.
Figure 6:
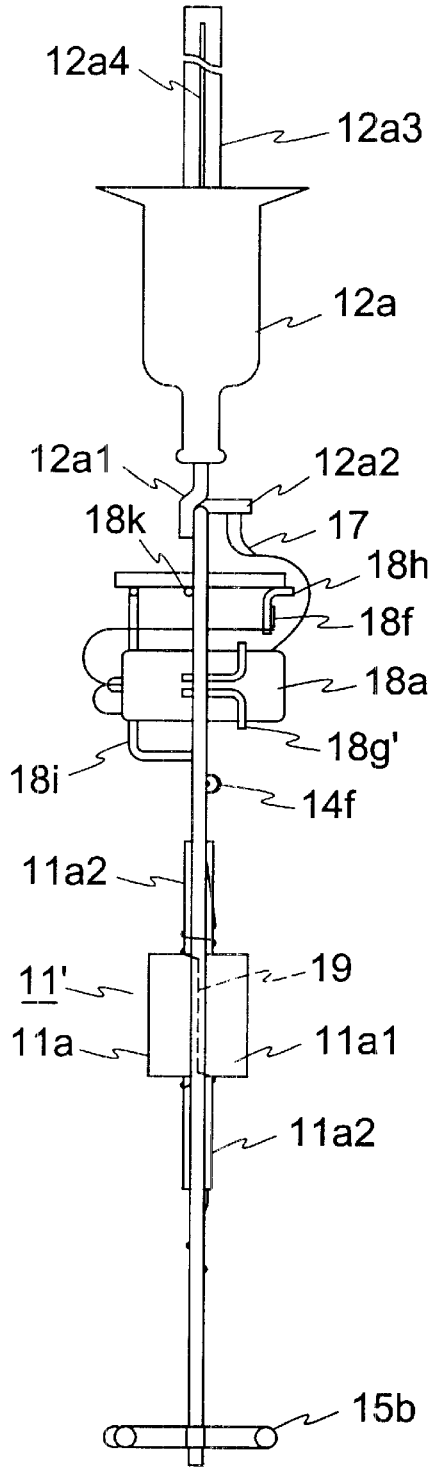
FIG. 6 is another side view of the assembly of the metal halide lamp shown in FIG. 5.

FIG. 5 shows a side view of an assembly of a metal halide lamp according to a second embodiment. An outer bulb and a lamp cap are not shown in FIG. 5. FIG. 6 shows another side view of the assembly of the metal halide lamp shown in FIG. 5. The same reference characters designate identical or corresponding elements as those of the first embodiment. Therefore, a detailed explanation of such structure will not be provided. In this embodiment, a glow starter 18*a* is the same as that of the first embodiment, and an arc tube 11 is made of light-transmitting ceramics.

The assembly is provided with an arc tube 11, a flare stem 12*a*, an upper supporting element 14', a lower supporting element 15', connecting conductors 17, a starting device 18, and a starting aid conductor 19.

The arc tube 11 comprises a discharge vessel 11*a* made of a light-transmitting ceramics, which has a discharge space portion 11*a*1 and sealing portions 11*a*2 formed at opposite ends of the discharge space portion 11*a*1. Each of the sealing portions 11*a*2 has a slit introduced a conductor 11*g*. The conductor 11*g* made of niobium (Nb) is also sealed in the slit by a sealing compound for the ceramics. A pair of electrodes (not shown), each respectively connected to one of the conductors 11*g*, is arranged in the discharge vessel 11*a*. The sealing compound seals the discharge vessel 11*a* at sealing portions 11*a*2, and also fixes the electrodes in the discharge space. The discharge vessel 11*a* is filled with a filling including mercury (Hg), a rare gas, e.g., argon (Ar), and a metal halide, e.g., sodium iodide (NaI), dysprosium iodide (DyI), and cesium iodide (CsI).

The flare stem 12*a* comprises a pair of inner conductive wires 12*a*1, 12*a*2, an exhaust tube 12*a*3, and a pair of outer conductive wires 12*a*4.

The upper supporting element 14' comprises a rectangular conductor 14*a*', a U-shaped conductor 14*d*, insulators 14*e*, 14*f*, and a lead wire 14*g*. The rectangular conductor 14*a*' is welded to the inner conductive wire 12*a*1, and is connected electrically thereto. The arc tube 11 is arranged between the legs of the rectangular conductor 14*a*'. One end of each of the insulators 14*e*, 14*f* is fixed to the rectangular conductor 14*a*', and the other end of each of the insulators 14*e*, 14*f* supports the U-shaped conductor 14*d*. The lead wire 14*g*, which is welded to the U-shaped conductor 14*d*, is also welded to the upper side of the arc tube 11.

The lower supporting element 15' comprises the rectangular conductor 14*a*', a pair of spring members 15*b*, a holding conductor 15*e*, and a lead wire 15*f*. The holding conductor 15*e* is welded to the rectangular conductor 14*a*' at each of its ends. The spring members 15*b*, which are welded to the rectangular conductor 14*a*', are arranged so as to touch the inner surface of the summit portion of an outer bulb (not shown). The lead wire 15*f*, which is welded to the U-shaped portion 15*e*1 of the holding conductor 15*e*, holds the lower side of the arc tube 11.

The connecting conductor 17 made of a ribbon-shaped wire is welded to the inner conductive wire 12*a*2 at one end. The other end of the connecting conductor 17 is welded to the U-shaped current conductor 14*d*.

The starting device 18' comprises a glow starter 18*a*, a ceramics resistor 18*b*', a metal holder 18*g*' supporting the glow starter 18*a*, connecting conductors 18*h*, 18*i*, and 18*j*, a contacting member 18*k*, and a bimetal element 18*f*. One outer conductive wire 3 of the glow starter 18*a* is connected to the connecting conductor 18*h*. The other outer conductive wire 3 of the glow starter 18*a* is welded to the rectangular conductor 14*a*'. The ceramics resistor 18*b*', embedded in a ceramics substrate, is connected to the connecting conductors 18*i*, 18*j*. The connecting conductor 18*i* is welded to the U-shaped current conductor 14*d*. The one end of the contacting member 18*k* is connected to the ceramics substrate, and the other end thereof is welded to the rectangular conductor 14*a*'. Therefore, both the ceramics substrate and the bimetal element 18*f*is held by the contacting member 18*k* and the connecting conductor 18*i*. The bimetal element 18*f* comprises a bimetal plate 18*f*1, and a contacting member 18*f*2.

The starting aid conductor 19 made of a fine conductive wire, is welded to the rectangular conductor 14*a*' at one end. The fine conductive wire 19 also is wound around the one sealing portion 11*a*2 twice, and arranged along the surface of the discharge portion 11*a*1. The other end of the fine conductive wire 19 is wound around the other sealing portion 11*a*2.

Moreover, the metal halide lamp has a rated lamp power of about 360 W, a luminous efficiency of about 901 m/W, a color temperature of about 4000K, and a general color rendering index of about 85.

Figure 7:
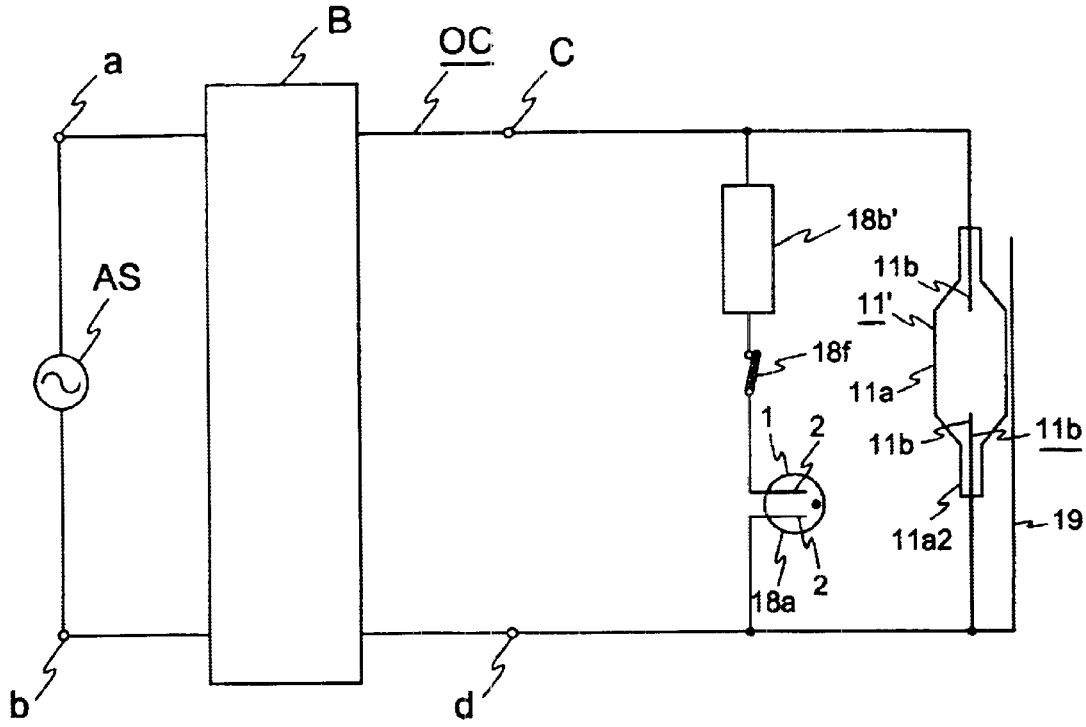
FIG. 7 is a circuit diagram of a high pressure discharge lamp apparatus according to the second embodiment of the present invention.

FIG. 7 shows a circuit diagram of a high pressure discharge lamp apparatus according to the second embodiment. The same reference characters designate identical or corresponding elements to the circuit diagram of the first embodiment shown in FIG. 3. Therefore, a detail explanation of such structure will not be provided. A series circuit, which includes the ceramics resistor 18*b*', the bimetal element 18*f*, and the glow starter 18*a*, is connected in parallel to the arc tube 11.

When the alternating current power AS is supplied to-a ballast B, which can be that used with mercury vapor lamps, the ballast generates a secondary voltage which is applied to the high pressure discharge lamp HPL. However, the high pressure discharge lamp HPL can not start yet. The glow starter 18*a* generates a glow discharge between the electrodes 2, when the secondary voltage is supplied to the high pressure discharge lamp HPL. The glow discharge generates ultraviolet rays of about 300 nm or less, e.g., 296 nm, so that the ultraviolet rays can irradiate the arc tube 11 through the discharge vessel 1. Furthermore, argon (Ar) also generates ultraviolet rays by means of resonance radiation. As a result, the photoelectric effect occurs in the arc tube 11, and secondary electrons are easily generated from the electrodes 1*b*. Furthermore, the electrodes 2 of the glow starter 18*a* are heated by the glow discharge thereof, so that the electrodes 2 deform and touch each other. After the electrodes 2 touch, the glow starter 18*a* operates as a resistor in order to drawn an appropriate current from the ballast B. For a while, the electrodes 2 cool because they are not generating a glow discharge. Therefore, the electrodes 2 separate from each other. Then, a starting pulse voltage, which is generated by a counter-electromotive force in the ballast B, is supplied between the upper electrode 1*b* and the starting aid conductor 19, so that an arc discharge starts between the upper electrode 1*b* and the starting aid conductor 19. The aid discharge aids a main discharge between the electrodes 1*b*. As a result, the high pressure discharge lamp HPL starts to light up. After a while, the main discharge also heats the bimetal element 18*f*, so that the contacting member 18*f*2 parts from the connecting conductor 18*j*. Therefore, the glow starter 18*a* cannot operate again because it is disconnected from the high pressure discharge lamp HPL.

Also in this embodiment, 20 of each of three metal halide lamps, which utilize glow starters and have the first, the second, or the comparative glass, were manufactured. The results of a starting test were the same as in the first embodiment. That is, the metal halide lamps, using the glow starter made of the first or the second glass, can start to light up rapidly at least in ten seconds. However, the metal halide lamps, using the glow starter and made of the comparative glass, cannot start in two minutes.

Figure 8:
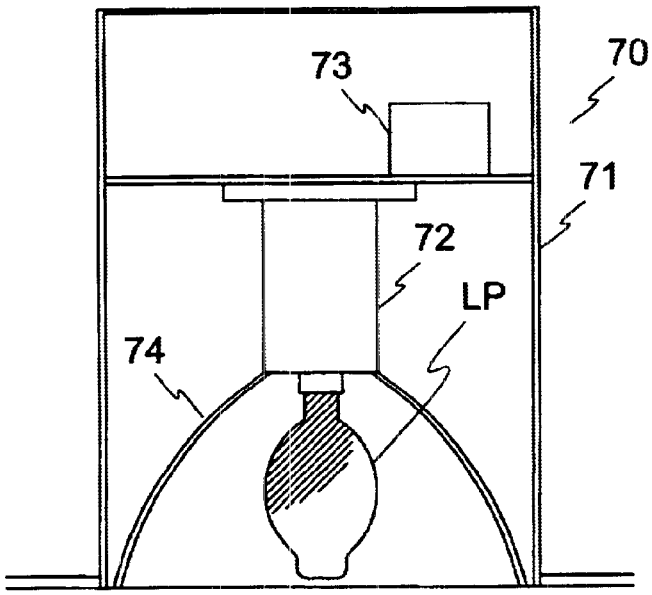
FIG. 8 is a side view, partly in section, of a lighting fixture according to the present invention.

2. FIG. 8 shows a side view, partly in section, of a lighting fixture. The lighting fixture 70 is provided with a body 71 having a lamp socket 72, a metal halide lamp LP of the first or second embodiment. A reflector 74 and ballast 73 are also provided in the body 71.

According to one aspect of the invention, a glow starter comprises a discharge vessel, filled with a gas mix including a rare gas. The glow starter transmits ultraviolet rays substantially of about 300 nm or less. A pair of electrodes, which are arranged in the discharge vessel, are adapted and arranged to touch each other as a result of being heated by a glow discharge.

What is claimed is:

1. A glow starter, comprising:

a soft glass discharge vessel, filled with a filling including a rare gas, substantially transmitting about 20% or more of ultraviolet rays having a wavelength of about 300 nm; and a pair of electrodes arranged in the discharge vessel and configured to touch each other when heated by a glow discharge.

2. A glow starter according to claim 1, wherein the rare gas is made of mainly argon (Ar).

3. A lighting fixture, comprising:

a high pressure discharge lamp apparatus, comprising:

a high pressure discharge lamp, comprising:

an arc tube;

a glow starter configured to irradiate the arc tube with ultraviolet rays, the glow starter comprising:

a soft glass discharge vessel, filled with a filling including a rare gas, substantially transmitting about 20% or more of ultraviolet rays having a wavelength of about 300 nm; and a pair of electrodes arranged in the discharge vessel and configured to touch each other when heated by a glow discharge; and an outer bulb accommodating the arc tube, and the glow starter; and a ballast having a rated voltage of about 100V, and configured to supply a secondary voltage between about 200V and about 220V to the high pressure discharge lamp, or having a rated voltage of about 200V, and arranged in series with the high pressure discharge lamp; and a body having a lamp socket and a reflector.

4. A glow starter, comprising:

a soft glass discharge vessel, filled with a filling including a rare gas, substantially transmitting about 20% or more of ultraviolet rays having a wavelength of about 254 nm; and a pair of electrodes arranged in the discharge vessel and configured to touch each other when heated by a glow discharge, wherein the filling further includes mercury (Hg).

5. A glow starter according to claim 4, wherein the soft glass of the discharge vessel comprises mainly silicone oxide ($SiO_2$) and about 0.01 percentage weight or less of iron oxide ($Fe_2O_3$).

6. A high pressure discharge lamp, comprising:

an arc tube;

a glow starter configured to irradiate the arc tube with ultraviolet rays, the glow starter comprising:

a soft glass discharge vessel, filled with a filing including a rare gas, substantially transmitting about 20% or more of ultraviolet rays having a wavelength of about 300 nm; and a pair of electrodes arranged in the discharge vessel and configured to touch each other when heated by a glow discharge; and an outer bulb arranged to accommodate the arc tube and the glow starter.

7. A high pressure discharge lamp apparatus, comprising:

a high pressure discharge lamp, the high pressure discharge lamp comprising:

an arc tube;

a glow starter configured to irradiate the arc tube with ultraviolet rays, comprising:

a soft glass discharge vessel, filled with a filling including a rare gas, substantially transmitting about 20% or more of ultraviolet rays having a wavelength of about 300 nm; and a pair of electrodes arranged in the discharge vessel and configured to touch each other when heated by a glow discharge; and an outer bulb arranged to accommodate the arc tube and the glow starter; and a ballast having a rated voltage of about 100V, and configured to supply a secondary voltage between about 200V and about 220V to the high pressure discharge lamp, or having a rated voltage of about 200V, and arranged in series with the high pressure discharge lamp.

* * * * *